US006263180B1

(12) United States Patent
VanLaeken et al.

(10) Patent No.: US 6,263,180 B1
(45) Date of Patent: Jul. 17, 2001

(54) CHARGE METERING BLADE WITH POLYURETHANE BASE AND LOW SURFACE ENERGY COATING THEREON

(75) Inventors: Anita C. VanLaeken; Laurence J. Lynd, both of Macedon, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/408,589

(22) Filed: Sep. 29, 1999

(51) Int. Cl.[7] ..... G03G 15/08; B05C 1/06

(52) U.S. Cl. ..... 399/284; 118/261; 399/274

(58) Field of Search ..... 118/261; 399/264, 399/273, 274, 283, 284, 351; 430/120

(56) References Cited

U.S. PATENT DOCUMENTS

| | | | | |
|---|---|---|---|---|
| 4,760,422 | * | 7/1988 | Siemiya et al. | 399/284 |
| 4,764,841 | * | 8/1988 | Brewington et al. | 361/226 |
| 5,097,294 | | 3/1992 | Nishio et al. | 355/245 |
| 5,168,312 | * | 12/1992 | Aoto et al. | 399/284 |
| 5,220,129 | | 6/1993 | Nishio et al. | 118/656 |
| 5,303,014 | * | 4/1994 | Yu et al. | 399/284 |
| 5,357,317 | | 10/1994 | Fukuchi et al. | 355/299 |
| 5,363,182 | | 11/1994 | Kuribayashi et al. | 355/299 |
| 5,369,478 | * | 11/1994 | Kobayashi | 399/284 |
| 5,400,128 | | 3/1995 | Michlin | 355/299 |
| 5,548,382 | | 8/1996 | Koshi et al. | 355/259 |
| 5,605,777 | | 2/1997 | Ando et al. | 430/97 |
| 5,663,788 | | 9/1997 | Sanpe | 399/353 |
| 5,895,150 | * | 4/1999 | Watabe et al. | 399/284 |
| 6,066,400 | * | 5/2000 | Law et al. | 428/412 |
| 6,067,430 | * | 5/2000 | Mammino et al. | 399/174 |

* cited by examiner

*Primary Examiner*—Arthur T. Grimley
*Assistant Examiner*—Hoang Ngo
(74) *Attorney, Agent, or Firm*—Annette Bade

(57) ABSTRACT

A blade assembly for use in charging and metering marking particles in a development unit is provided. The blade assembly includes a shim and a polyurethane conformable base layer attached to the shim. The blade assembly also includes a low surface energy material coated on the polyurethane conformable base layer.

20 Claims, 3 Drawing Sheets

CHARGE METERING BLADE WITH POLYURETHANE BASE AND LOW SURFACE ENERGY COATING THEREON

CROSS REFERENCE TO RELATED APPLICATIONS

Attention is directed to the following copending application assigned to the assignee of the present application: application Ser. No. 09/408,587 filed Sep. 29, 1999, entitled, "Charge Metering Blade with Low Surface Energy Coating Thereon." The disclosure of this application is hereby incorporated by reference in its entirety.

BACKGROUND OF THE INVENTION

This invention relates to electrostatographic reproduction machines, and more particularly to a process cartridge for use in an electrostatographic reproduction machine. Specifically this invention relates to such a cartridge including a charge metering blade. In an embodiment, the blade includes an elastomeric surface tailored to enhance toner's charge prior to transfer to an imaging member. In a particularly preferred embodiment, the charge metering blade has a polyurethane base and a low surface energy coating thereon.

Generally, the process of electrostatographic reproduction includes charging an imaging member to a substantially uniform potential so as to sensitize the surface thereof. A charged portion of the photoconductive surface is exposed at an exposure station to a light image of an original document to be reproduced, thereby producing a latent image of the original image onto the imaging member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known that a number of the elements and components of an electrostatographic reproduction machine can be combined to form a customer or user replaceable unit CRU. Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge.

In single component development as described above, the particle of toner is charged prior to development of the toner onto the photoreceptive drum by rubbing the particle between a charge-metering blade and a donor roll. The charged particles on the periphery of the donor roll are then transferred onto the imaging member at the charged portions of the surface of the imaging member or the latent image to form the developed image on the imaging member. The developed image is then transferred onto a copy substrate, such as paper.

In the process of transferring the toner from the surface of the donor roll onto the paper, some of the toner remains on the surface of the donor roll. The toner, which remains on the surface of the donor roll, has a residual charge that may accumulate on the donor roll. When the surface of the magnetic roll is exposed to toner from the sump to be reloaded for further image development, the toner which remains on the surface of the donor roll combines with fresh toner from the sump. These accumulated or residual charges are not uniformly distributed on the periphery of the donor roll, and in fact, correspond to the developed image of the imaging member. These accumulated or residual charges cause less toner to be attracted to the periphery of the donor roll at areas which correspond to a concentrated or solid developed image of the imaging member. The result is ghosting or underdevelopment of an area upon the substrate or paper.

Such ghosting phenomenon is more acute in solid area development where large areas are required to have a dark or solid image. The accumulated or residual charges reduce the amount of fresh toner attracted onto the magnetic roll. Therefore, some areas have a lighter than desired image.

The surface of the blade may also become contaminated with toner material that is advanced by the donor roll and passes by the surface of the blade. This contamination occurs because the toner will not separate from the surface of the blade. In fact, long clusters of toner may form on the blade. These clusters have a greater tendency of forming at the edge of the blade. As these clusters form on the blade, the clusters of toners deplete the donor roll or clean the layer of toner from the donor roll. The portion of the donor roll which has been depleted causes streaks to occur on the latent image, and therefore, the copy substrate.

The following disclosures may be relevant to various aspects of the present invention:

- U.S. Pat. No. 5,663,788, Patentee: Sanpe, Issue Date: Sep. 2, 1997;
- U.S. Pat. No. 5,605,777, Patentee: Ando, et al., Issue Date: Feb. 25, 1997;
- U.S. Pat. No. 5,548,382, Patentee: Koshi, et al., Issue Date: Aug. 20, 1996;
- U.S. Pat. No. 5,400,128, Patentee: Michlin, Issue Date: Mar. 21, 1995;
- U.S. Pat. No. 5,363,182; Patentee: Kuribayashi, et al., Issue Date: Nov. 8, 1994;
- U.S. Pat. No. 5,357,317, Patentee: Fukuchi, et al., Issue Date: Oct. 18, 1994;
- U.S. Pat. No. 5,220,129, Patentee: Nishio, et al., Issue Date: Jun. 5, 1993; and
- U.S. Pat. No. 5,097,294, Patentee: Nishio, et al., Issue Date: Mar. 17, 1992.

U.S. Pat. No. 5,663,788 discloses an electrostatic image forming apparatus having high cleaning efficiency using the electrostatic fur brush method.

U.S. Pat. No. 5,605,777 discloses a predetermined processing liquid supplied by a liquid supplying unit to a sheet of transfer paper having a surface on which toner is stably attached.

U.S. Pat. No. 5,548,382 discloses a developing device using a one-component developer.

U.S. Pat. No. 5,400,128 discloses in toner cartridge assemblies for use in copiers, printers and facsimile machines, a conductive coating which is applied to the wiper and spreader blades. The wiper blade has a coating comprising polytetrafluoroethylene (TEFLON®) made conductive by the addition of a conductive substance.

U.S. Pat. No. 5,363,182 discloses a blade device for use in contact with an object such as an image-carrying photosensitive drum of an image forming apparatus. The blade device has a blade body made of urethane rubber, a surface coating layer and an underlying primer layer.

U.S. Pat. No. 5,097,294 discloses a developing device including a blade member provided within the vessel and is resiliently engaged with the developing roller for regulating a thickness of the developer layer formed therearound.

SUMMARY OF THE INVENTION

Embodiments include: a blade assembly for use in charging and metering marking particles in a development unit, the blade assembly comprising a shim; a conformable base layer attached to the shim; and a low surface energy material coated on the conformable base layer.

Embodiments further include: a developer unit for developing a latent image with marking particles, the developer unit comprising a housing defining a chamber for storing a supply of marking particles therein; an advancing member for advancing the marking particles on a surface thereof from the chamber of the housing in a first direction toward the latent image; and a blade assembly for charging and metering the marking particles, the blade assembly including a shim, a conformable base layer attached to the shim and a low surface energy material coated on the conformable base layer.

Also, embodiments include: an electrostatographic machine of the type including a process cartridge comprising a housing defining a chamber for storing a supply of marking particles therein; an advancing member for advancing the marking particles on a surface thereof from the chamber of the housing in a first direction toward the latent image; and a blade assembly for charging and metering the marking particles, the blade assembly including a shim, a conformable base layer attached to the shim and a low surface energy material coated on the conformable material.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

A shim is defined as a piece of material used to fill a space between things. For example, a shim can be used for support, leveling or adjustment to fit. A shim may comprise wood, metal, plastic, stone, or like materials capable of supporting a blade member.

Conformable is defined as a pliant material which deforms to match (or clone) any surface it comes in contact with. A conformable material is typically an elastic, polymeric material that readily deforms with little or no external force.

Low surface energy is defined as a non-wettable surface and can produce a large contact angle, including contact angles greater than about 40 degrees, and preferably from about 40 to about 80 degrees.

Figure 1:
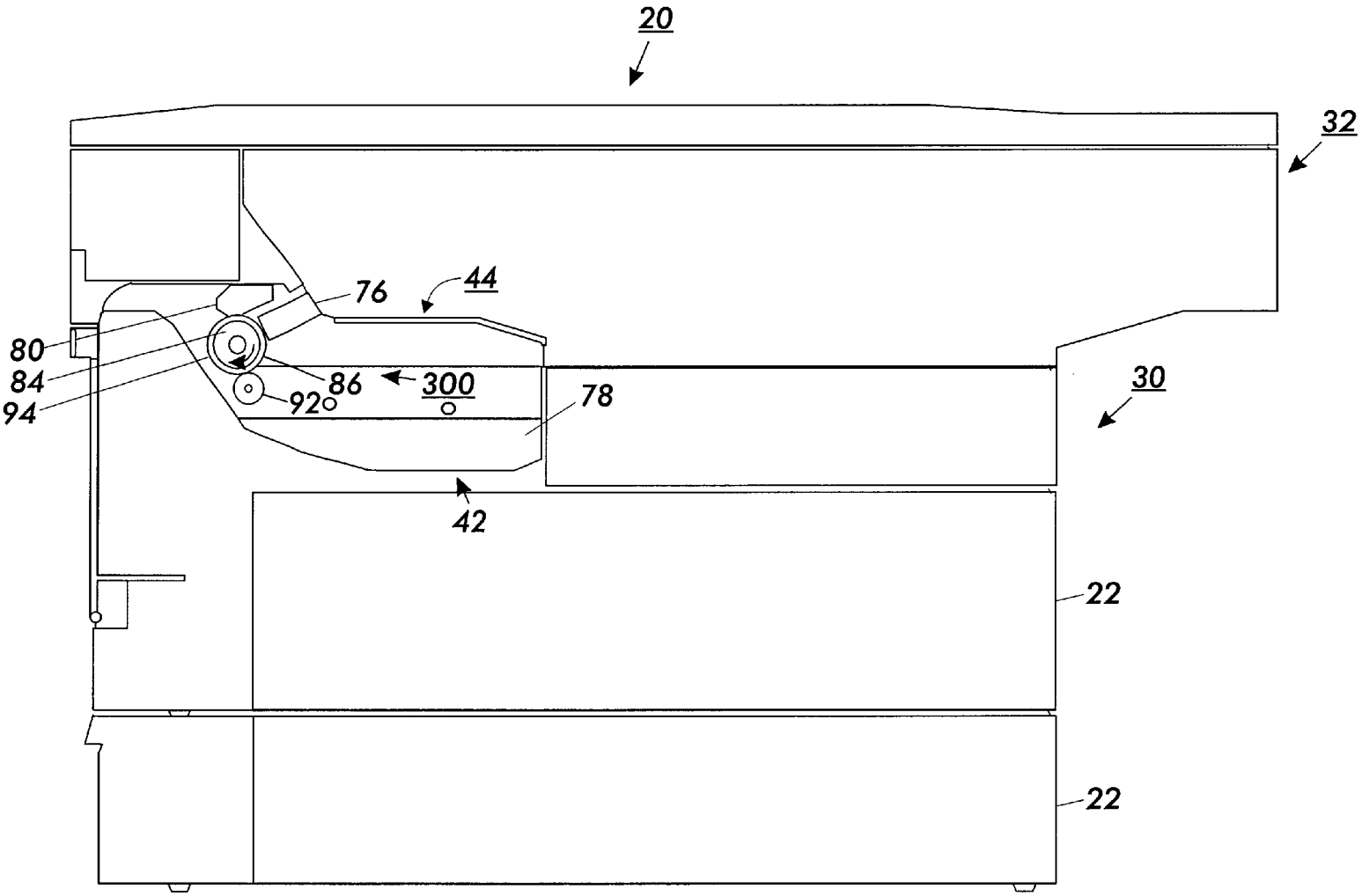
FIG. 1 is a frontal view of an electrostatographic machine.

Illustrated in FIG. 1 is a frameless exemplary compact electrostatographic reproduction machine 20 comprising separately framed mutually aligned modules. As shown, the frameless machine 20 comprises at least a framed copy sheet input module (CIM) 22. Preferably, the machine 20 comprises a pair of copy sheet input modules. The machine 20 also comprises a framed electronic control and power supply (ECS/PS) module 30, that as shown mounts onto, and is mutually aligned against the CIM 22 (which preferably is the top or only copy sheet input module). A framed latent image forming imager module 32 mounts over and is mutually aligned against the ECS/PS module. The ECS/PS module 30 includes all controls and power supplies (not shown) for all the modules and processes of the machine 20.

The framed copy sheet input modules 22, 24, the ECS/PS module 30, and the imager module 32, as mounted above, define a cavity 42. The machine 20 may include a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

Figure 2:
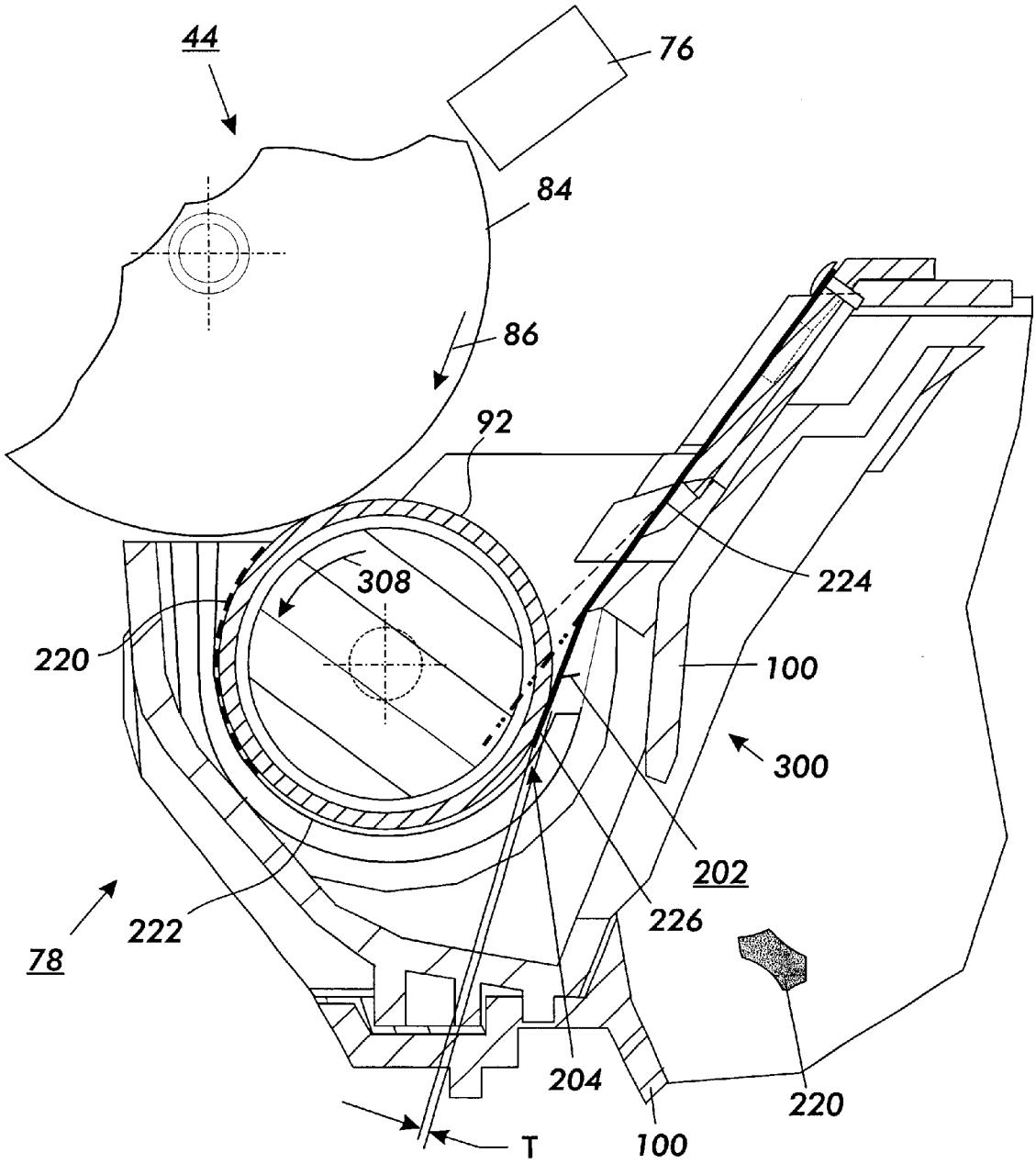
FIG. 2 is a partial enlarged view of a process cartridge including a donor member and charge metering blade.

Referring now to FIG. 2 in addition to FIG. 1, the CRU or process cartridge module 44 generally comprises a photoreceptor subassembly (not shown), a charging subassembly 76, a developer subassembly 78 including a source of fresh developer material, a cleaning subassembly 80 for removing residual toner as waste toner from a surface of the photoreceptor, and a waste toner sump subassembly (not shown) for storing waste toner.

Operation of an imaging cycle of the machine 20 using the all-in-one process cartridge module 44 can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light (not shown) which forms a latent image on the drum 84, corresponding to an image of a document. The portion of the drum 84 bearing a latent image is then rotated to the developer subassembly 78 where the latent image is developed with developer material such as with charged single component magnetic toner using a developer member 92, preferably a magnetic donor member, of the process cartridge module 44. The developed image on the drum 84 is then rotated to a near vertical transfer point 92 where the toner image is transferred to a copy sheet substrate. The copy sheet substrate with the transferred toner image thereon, is then directed to the fusing station, wherein the developed image is fused to the copy substrate.

The portion of the drum 84 from which the developed toner image was transferred, is then advanced to a cleaning subassembly where residual toner and residual charge on the drum 84 are removed therefrom. The imaging cycle of the machine 20 using the drum 84 can then be repeated for forming and transferring another toner image as the cleaned portion again comes under the charging subassembly 76.

A blade assembly 300 is shown as part of the development unit 78. The blade assembly 300 includes a blade 202. The blade 202 defines a free edge 204 on one end thereof. The blade 202 includes a shim 224 and a tip body 226 attached to the shim 224. The free edge 204 is used for regulating the thickness of the layer of marking particles on the surface of the periphery of the developer roll 92. During operation of the developer unit 78, the free edge 204 of the regulating blade 202 is spaced a distance T from the surface of the magnetic developer roll 92.

As the magnetic developer roll 92 rotates in the direction of arrow 308, the magnet (not shown) draws marking particles 220 toward the roll 92. The outer periphery 222 of the roll 92 advances to marking particles 220 in the direction of arrow 308 toward the blade 202. The marking particles 220 are urged between the roll 92 and the blade 202, thereby regulating the thickness of the layer of particles 220. The particles 220 are rubbed by the blade 202 against the roll 92 and thereby charged. The outer periphery 222 of the roll 92 then advances the marking particles 220 in the direction of arrow 308 toward the latent image 302 on the drum 84. As the magnetic developer roll 92 rotates further in the direction of arrow 308, the magnet draws new marking particles 220 toward the roll 92 and the process is repeated.

While the blade 202, as shown in FIG. 2, may have a generally planar shape, it should be appreciated that the regulating blade 202 may have any shape, which may charge the marking particles and regulate the thickness of the marking particles. For example the regulating blade may be cylindrical or rectangular.

Preferably, the blade 202 may include a shim 224 operably connected to the modular housing 100. The shim 224 is preferably made of a durable, supportive material, for example a metal, plastic, wood, stone or like supportive material capable of supporting a blade.

It is desired that the length of the shim be equal to or slightly greater than the length of the attached blade. The length of the shim 224 is from about 50 mm to about 500 mm, and preferably from about 100 to about 250 mm. The thickness of the shim 224 is preferably from about 10 to about 100, and preferably from about 30 to about 70 mils.

Figure 3:
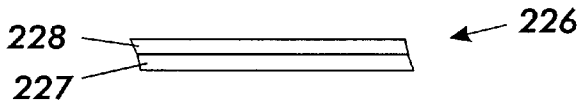
FIG. 3 is an enlarged view of a charge metering blade showing preferred layering thereof.

Turning to FIG. 3, the tip body 226 comprises a conformable base layer 227, coated with a low surface energy coating 228. The base layer 227 is attached to the shim. The base layer 227 is preferably made of a conformable material. For example, the base layer may be made of an elastomer. Preferably the elastomer is tailored to enhance the donor charge. The elastomer preferably provides for a smooth conformable and compliant surface for cooperation with the donor roll 92. Preferably, the base layer is made of a polyurethane, silicone rubber, fluoroelastomer or VITON® elastomer. In a particularly preferred embodiment, the base layer comprises a polyurethane material. Preferably, the base layer has a thickness of from about 10 to about 40 mils, and particularly preferred of from about 20 to about 30 mils. Preferably, the base layer has a hardness of from about 50 to about 70 Shore A.

The low surface energy material 228 is selected to provide enhanced appropriate triboelectric charging. The coating preferably is resistant to or has a low affinity for toner. Further, the low surface energy material is triboelectrically active. Such suitable materials for the coating include fluoropolymers such as fluoroelastomers, polytetrafluoroethylene (PTFE), fluorinated ethylene propylene (FEP), perfluoroalkoxy resin (FPA), polytetrafluoroethylene (PTFE), and other TEFLON®-like materials, polyamides, polyimides, polyurethanes. Examples of commercially available polyamides include those sold under the trademark NYLON® such as NYLON® 66. Examples of fluoroelastomers include copolymers, terpolymers and tetrapolymers of vinylidene fluoride, hexafluoropropylene, tetrafluoroethylene and optional cure site monomer. Examples of these preferred fluoroelastomers include those sold under the trademark VITON® from DuPont and include VITON E45®, VITON B50®, VITON A®, VITON B®, VITON E®, VITON E60C®, VITON E430®, VITON 910®, VITON GH® and VITON GF®. In another preferred embodiment, the fluoroelastomer is one having a relatively low quantity of vinylidenefluoride, such as in VITON GF®, available from E.I. DuPont de Nemours, Inc. The VITON GF® has about 35 weight percent of vinylidenefluoride, about 34 weight percent of hexafluoropropylene and about 29 weight percent of tetrafluoroethylene with about 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer. The VITON® designation is a Trademark of E.I. Du Pont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly (propylene-tetrafluoroethylenevinylidenefluoride) both also available from 3M Company, as well as the Technoflons identified as FOR-60KIR®, FOR-LHF®, NM® FOR-THF®, FOR-TFS®, TH®, TN505® available from Montedison Specialty Chemical Company. The coating preferably is a uniform continuous coating. Preferably, the coating is of a thickness of from about 0.01 to about 5, and particularly preferred of from about mils 0.1 to about 2 mils.

The coating 228 may be applied to the base layer 227 in any suitable fashion. For example, the coating may comprise a separate sheet or material which may be adhesively attached to the base layer, or formed by layering, solution coating or by spray coating.

Figure 4:
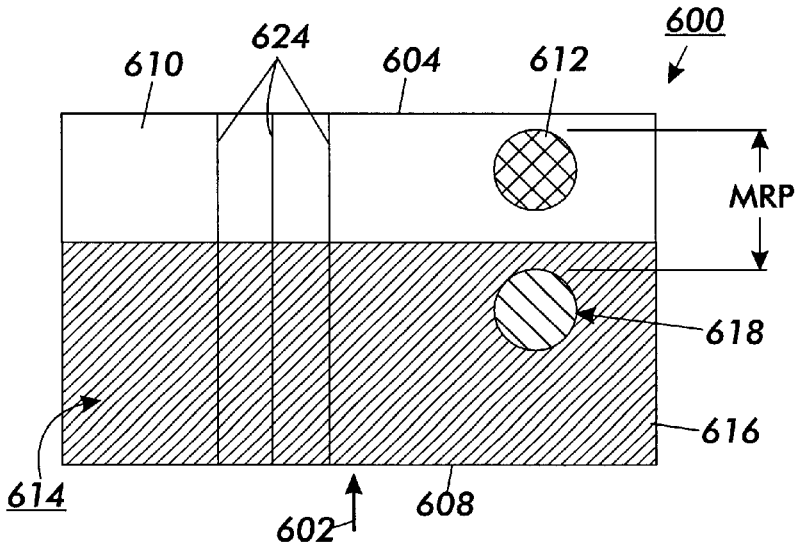
FIG. 4 PRIOR ART
FIG. 4 is a schematic representation of a sheet of paper onto which a solid circle and a half toned area being sequentially printed from the same peripheral area of a development roll with a prior art metering blade.

Referring now to FIG. 4, a copy or print substrate 600 in the form of a sheet is shown which has been developed by a prior art developer unit affected by ghosting. The sheet 600 has been developed on a developer unit with the sheet 600 being advanced in the direction of arrow 602 from the top portion 604 to the bottom portion 608 of the sheet 600. Thus, the sheet 600 has a first upper portion 610 in which a dark area 612 is first developed. The developer roll (not shown) cooperates with area 610 in which no toner particles are transferred to the sheet 600 and a second area 612 in which many marking particles are transferred to obtain the dark area. Since the area of sheet 600 includes the white area 610 as well as a concentrated dark area 612, the transfer of charge by the marking particles onto the magnetic roll is not uniform. In fact, toner remaining after transfer on the area on the magnetic roll corresponding to dark area 612 has considerably less charge than that on the remaining area of the magnetic roll. This phenomenon is caused because a significantly greater amount of charge is required to be transferred onto the sheet 600 at the dark area 612.

The affect of low tribo is graphically shown as the effect of ghosting on a subsequent half-tone portion 614 of sheet 600. For example, sheet 600 further includes a second subsequent portion 614 which includes a half-tone pattern area 616. While the whole lower area 614 should have the half-tone pattern 616, the portion 618 which corresponds to the dark area 612 of the sheet 600 is not darkened. The portion 618 is a distance MRP or one magnetic roll pitch from portion 612. The distance MRP corresponds to the circumference of the developer roll. The portions 612 and 618 correspond to the portion of the developer roll where the charge on the developer roll is less than the remainder of the developer roll. Because of the lower charge on the ghosting area 618, the exposure of the lower area 614 which should appear as the half-tone pattern 616 has a light or less developed area 618 which has been defined as ghosting. Further, the excess lumps of toner in certain areas on the periphery of the magnetic roll cause streaks 624 to form on the sheet 600.

Figure 5:
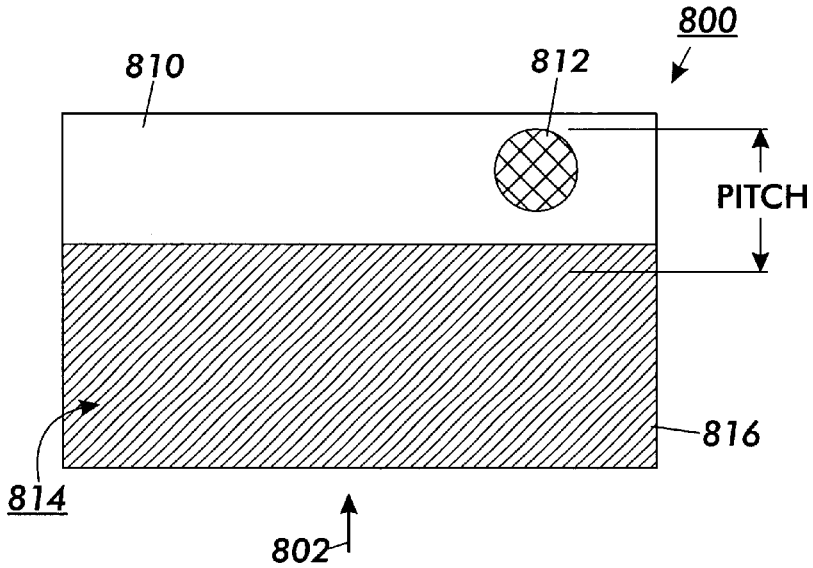
FIG. 5 is a schematic representation of a sheet of paper onto which a solid circle and a half toned area being sequentially printed from the same peripheral area of a development roll with the low surface energy charge metering blade of the present invention.

Referring now to FIG. 5, a exemplary sheet 800 is shown including a dark area 812 within white area 810 using an embodiment of a blade of the present invention. As the sheet 800 is advanced in the direction of arrow 802, a second portion 814 of the sheet 800 having a half-tone pattern 816 is shown. It should be appreciated that the second portion 814 of the sheet 600 is not affected by the dark area 812 and that the sheet 800 does not include the streaks shown in FIG. 4.

The charge metering blade, in embodiments, is compliant and conformable to the donor member surface. The blade further reduces the pile height of the toner to the appropriate thickness and imparts a triboelectric charge to the toner's surface enhancing the potential for correctly signed toner to be transferred to the photoreceptor. Preferably, the surface of the coating of the blade is uniform and continuous. Also, preferably, the blade surface is beveled at both edges to minimize the possibility of toner collecting at the edges to form large, clusters of particles capable of causing streaks by depleting the toner in selected areas of the donor member. Depending on the desired toner charge, the surface of the blade can be tailored to maximize this charge.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

EXAMPLES

Example 1

Preparation of Charge Metering Blade with Polyurethane Base and Various Outer Coatings Experimental samples of polyurethane tapes were obtained from 3M Corporation. The tapes were 250 mm in length and ranged from about 0.007 to about 0.025 inches in thickness. The tapes were layered on top of one another with the adhesive in between.

The following coatings having the same dimensions were positioned over the polyurethane tapes: polytetrafluoroethylene (5480 and 5490 from DuPont), polyamide (NYLON® 855 and 8555 from 3M), and filled polyurethane (8663 and 8671 obtained from 3M) were adhered to the tapes; and polytetrafluoroethylene (MCLUBE® 1700) was spray coated onto the polyurethane tapes.

Example 2

Preparation of Charge Metering Blade with Shim

A stainless steel shim having a length of from about 300 to about 400 mm was bonded to a blade using double back tape. The blade having the configurations set forth in Example 1 had lengths of about 250 mm and a thickness of about 20 mils. The finished charge metering blade was tested in laser printer machines using black ramless toners and color toners.

About 20 to 600 prints were printed using each of the blades of Example 1. Print quality was measured visually. Inferior print quality included visible streaks or deletions appearing in each image. With poor quality blades, these defects would show up in the first 25 to 75 prints.

The results demonstrated the polytetrafluoroethylene-coated blades exhibited superior results. Specifically, the PTFE coated blades demonstrated unexpectedly superior results by lasting more than 250 prints.

The polyamide coated prints performed well, lasting from about 150 to about 250 prints.

The filled polyurethane coated prints performed well also, lasting from about 100 to about 175 prints.

The spray coated PTFE coated blades did not perform well because the coating abraded off the polyurethane base.

We claim:

1. A blade assembly for use in charging and metering marking particles in a development unit, said blade assembly comprising:

a shim;

a conformable base layer attached to said shim; and a low surface energy material coated on the conformable base layer, wherein said conformable base layer comprises a polyurethane, and wherein said low surface energy material is a material selected from a group consisting of fluoropolymers and polyimides.

2. A blade assembly in accordance with claim 1, wherein said fluoropolymers are selected from the group consisting of fluorinated ethylene propylene, perfluoroalkoxy resin, polytetrafluoroethylene, and polymers thereof.

3. A blade assembly in accordance with claim 2, wherein said fluoropolymers is polytetrafluoroethylene.

4. A blade assembly in accordance with claim 1, wherein said fluoropolymers is a fluoroelastomer selected from the group consisting of a) copolymers of vinylidene fluoride, hexafluoropropylene and tetrafluoroethylene, b) terpolymers of vinylidene fluoride, hexafluoropropylene and tetrafluoroethylene, and c) tetrapolymers of vinylidene fluoride, hexafluoropropylene, tetrafluoroethylene, and a cure site monomer.

5. A blade assembly in accordance with claim 1, wherein said conformable base layer has a thickness of from about 10 to about 40 mils.

6. A blade assembly in accordance with claim 5, wherein said conformable base layer has a thickness of from about 20 to about 30 mils.

7. A blade assembly in accordance with claim 1, wherein said low surface energy material coating has a thickness of from about 0.01 to about 5 mils.

8. A blade assembly in accordance with claim 7, wherein said low surface energy material coating has a thickness of from about 0.1 to about 2 mils.

9. A blade assembly in accordance with claim 1, wherein said low surface energy material is coated on the conformable base layer by one of adhesion, solution coating or spray coating.

10. A blade assembly in accordance with claim 1, wherein said low surface energy material coated conformable base layer is attached to said shim at one end of said shim.

11. A blade assembly in accordance with claim 1, wherein said shim has a thickness of from about 10 to about 100 mils.

12. A blade assembly in accordance with claim 11, wherein said shim has a thickness of from about 30 to about 70 mils.

13. An electrostatographic machine of the type including a process cartridge comprising:

a housing defining a chamber for storing a supply of marking particles therein;

an advancing member for advancing the marking particles on a surface thereof from the chamber of said housing in a first direction toward a latent image; and a blade assembly for charging and metering the marking particles, said blade assembly including a shim, a conformable base layer attached to said shim, and a low surface energy material coated on the conformable base layer, wherein said conformable base layer comprises a polyurethane, and wherein said low surface energy material is a material selected from a group consisting of fluoropolymers and polyimides.

14. An electrostatographic machine in accordance with claim 13, wherein said fluoropolymers are selected from the group consisting of fluorinated ethylene propylene, perfluoroalkoxy resin, polytetrafluoroethylene, and polymers thereof.

15. An electrostatographic machine in accordance with claim 14, wherein said fluoropolymers is polytetrafluoroethylene.

16. An electrostatographic machine in accordance with claim 13, wherein said fluoropolymers is a fluoroelastomer selected from the group consisting of a) copolymers of vinylidene fluoride, hexafluoropropylene and tetrafluoroethylene, b) terpolymers of vinylidene fluoride, hexafluoropropylene and tetrafluoroethylene, and c) tetrapolymers of vinylidene fluoride, hexafluoropropylene, tetrafluoroethylene, and a cure site monomer.

17. An electrostatographic machine in accordance with claim 13, wherein said conformable base layer has a thickness of from about 20 to about 30 mils.

18. An electrostatographic machine in accordance with claim 13, wherein said low surface energy material coating has a thickness of from about 0.1 to about 2 mils.

19. An electrostatographic machine in accordance with claim 13, wherein said shim has a thickness of from about 30 to about 70 mils.

20. A blade assembly for use in charging and metering marking particles in a development unit, said blade assembly comprising:

a shim;

a conformable base layer attached to said shim; and a low surface energy material coated on the conformable base layer, wherein said conformable base layer comprises a polyurethane, and wherein said low surface energy material is a fluoropolymer.

* * * * *